United States Patent [19]

Bergenwall

[11] Patent Number: 4,821,351

[45] Date of Patent: Apr. 18, 1989

[54] BED AND/OR CHAIR DEVICE

[75] Inventor: Henning Bergenwall, Sollentuna, Sweden

[73] Assignee: Molnlycke AB, Molnlycke, Sweden

[21] Appl. No.: 88,822

[22] Filed: Aug. 24, 1987

[30] Foreign Application Priority Data

Aug. 27, 1986 [SE] Sweden ..... 8603607

[51] Int. Cl.[4] ..... A61G 7/06

[52] U.S. Cl. ..... 5/67; 5/69

[58] Field of Search ..... 5/67, 68, 69, 181, 202, 5/14, 17, 28, 29, 30, 31; 297/405, 105, 457

[56] References Cited

U.S. PATENT DOCUMENTS

| | | | |
|---|---|---|---|
| 3,094,713 | 6/1963 | Wise | 5/67 |
| 3,184,765 | 5/1965 | Katz | 5/67 |
| 3,253,285 | 5/1966 | Fox | 5/67 |
| 3,353,193 | 11/1967 | Greiner | 5/69 X |
| 3,665,528 | 5/1972 | Kjellberg | 5/69 X |
| 3,797,050 | 3/1974 | Benoit | 5/62 |

*Primary Examiner*—J. Franklin Foss

*Attorney, Agent, or Firm*—Zarley, McKee, Thomte, Voorhees & Sease

[57] ABSTRACT

A bed and/or chair device comprises a stand (1) and a support surface arrangement (2, 3, 4), which is divided in at least two mutually movable parts, namely a back support (2) and a thigh supporting and possibly also seat supporting part (3), the back support (2) and the thigh supporting part (3) being pivotably connected to the stand (1), a power means (11) being arranged to cause a pivoting movement of the back support (2) between different inclination positions with respect to the stand (1). A transmission arrangement is arranged to make the movement of the back support and the thigh supporting part dependent on each other, so that, in pivoting the back support (2) upwardly from a substantially horizontal position, the thigh supporting part (3) is initially pivoted upwardly with respect to the stand (1), until a maximally raised position is reached, after which a continued pivoting upwardly of the back support causes the thigh supporting part to pivot downwardly towards its initial position.

13 Claims, 9 Drawing Sheets

BED AND/OR CHAIR DEVICE

FIELD OF THE INVENTION AND PRIOR ART

This invention relates to a bed and/or chair device according to the preamble of the appended claim 1.

In a device or piece of furniture of this type the body of the person resting in the piece of furniture tends to slide downwards the back support, when the back support is pivoted upwardly from a substantially horizontal position, through which the body is subjected to shearing forces. Since the persons resting in this type of devices in most cases are motion handicapped, besides that these shearing forces can cause fysical injuries, it may be impossible for the person in question to bring himself back to a desired position if he has slid too far in the downward direction during the raising of the back support.

It is possible to provide an up-incline, against which the thighs and the seat of the person bear, in order to counteract said shearing forces and prevent a sliding movement. Bed and chair devices for this purpose already exist, in which the thigh supporting part can be pivoted upwardly in order to form such an up-incline, at the same time as the back support is pivoted upwardly. In these devices the arrangements for controlling these simultaneous movements are too complicated and the controlling is not carried out in the most favourable way with respect to the forces involved.

SUMMARY OF THE INVENTION

The object of the present invention is to reduce the problems mentioned above in bed and chair devices when the back support is raised.

This object is obtained by providing a bed and chair device of the above type with the characteristics defined in the characterizing part of the appended claim 1.

The shearing forces acting on the body do initially increase, when the back support is raised from a substantially horizontal position, until an inclination of about 45° with respect to a horizontal plane is obtained, after which said forces decrease. Thus, it would be appropriate if an up-incline under the thighs of the person gradually increases during the pivoting upwardly of the back support until the position characterized by a maximum of shearing forces is reached, after which it decreases gradually during the continuation of the pivoting upwardly of the back support. This can be obtained thanks to the transmission arrangement according to the invention, which arrangement makes the movements of the back support and the thigh supporting part dependent on each other. By this the shearing forces mentioned above are counteracted in such an efficient way as possible and a sliding downwards the device is prevented.

BRIEF DESCRIPTION OF THE DRAWINGS

With reference to the appended drawings, below follows a detailed description of preferred embodiment examples according to the invention.

In the drawings.

DETAILED DESCRIPTION OF PREFERRED EMBODIMENTS

The bed and chair device according to the invention will hereinafter be called "the bed", but it should be observed that it is just as possible that the piece of furniture fulfill its main function as chair as well as bed.

Figure 1:
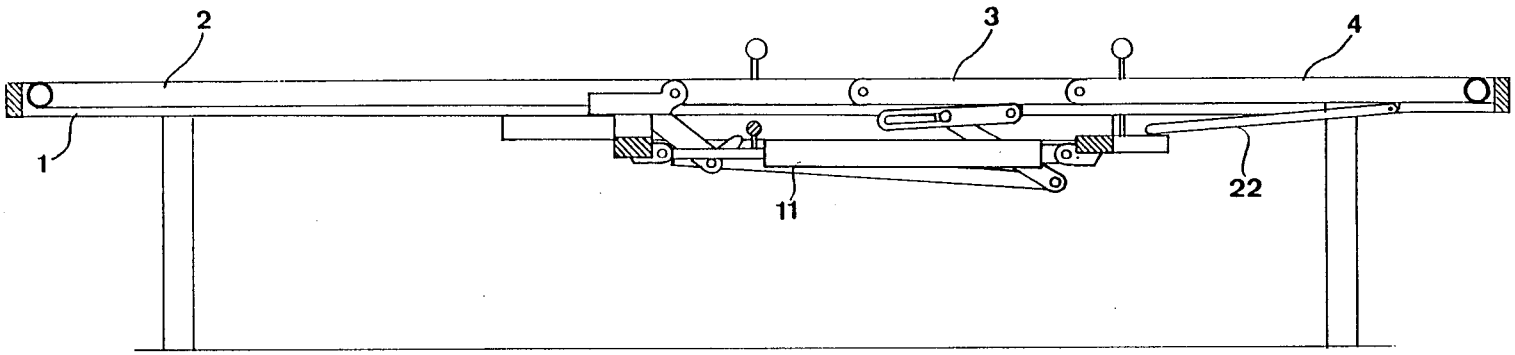
FIG. 1 is a side elevation of a first embodiment of the piece of furniture according to the invention, in which covering and stuffing elements have been omitted for the sake of clearness, and the piece of furniture is in a horizontal lying position.
Figure 2:
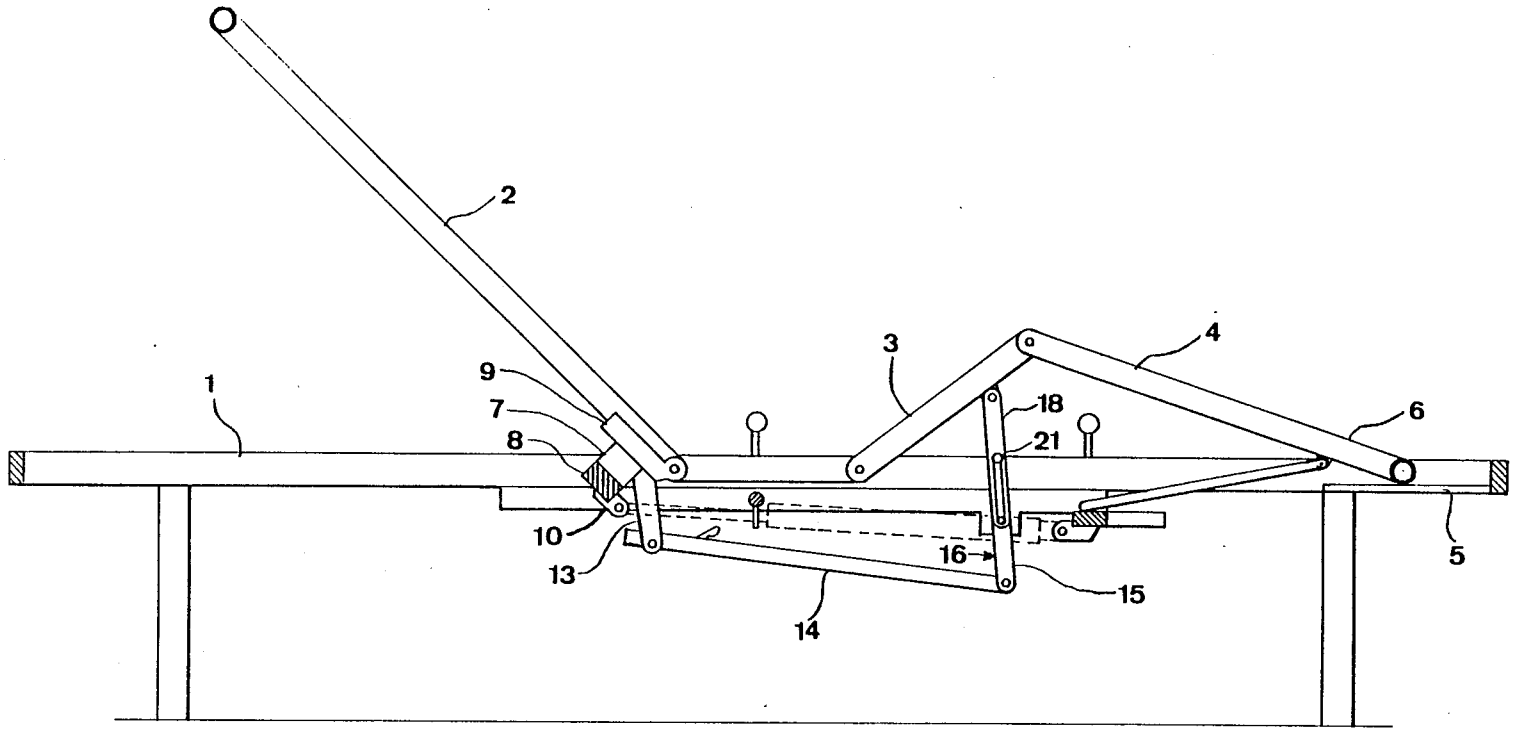
FIG. 2 is a side-elevation of the piece of furniture in FIG. 1, but with the back support partly raised.
Figure 3:
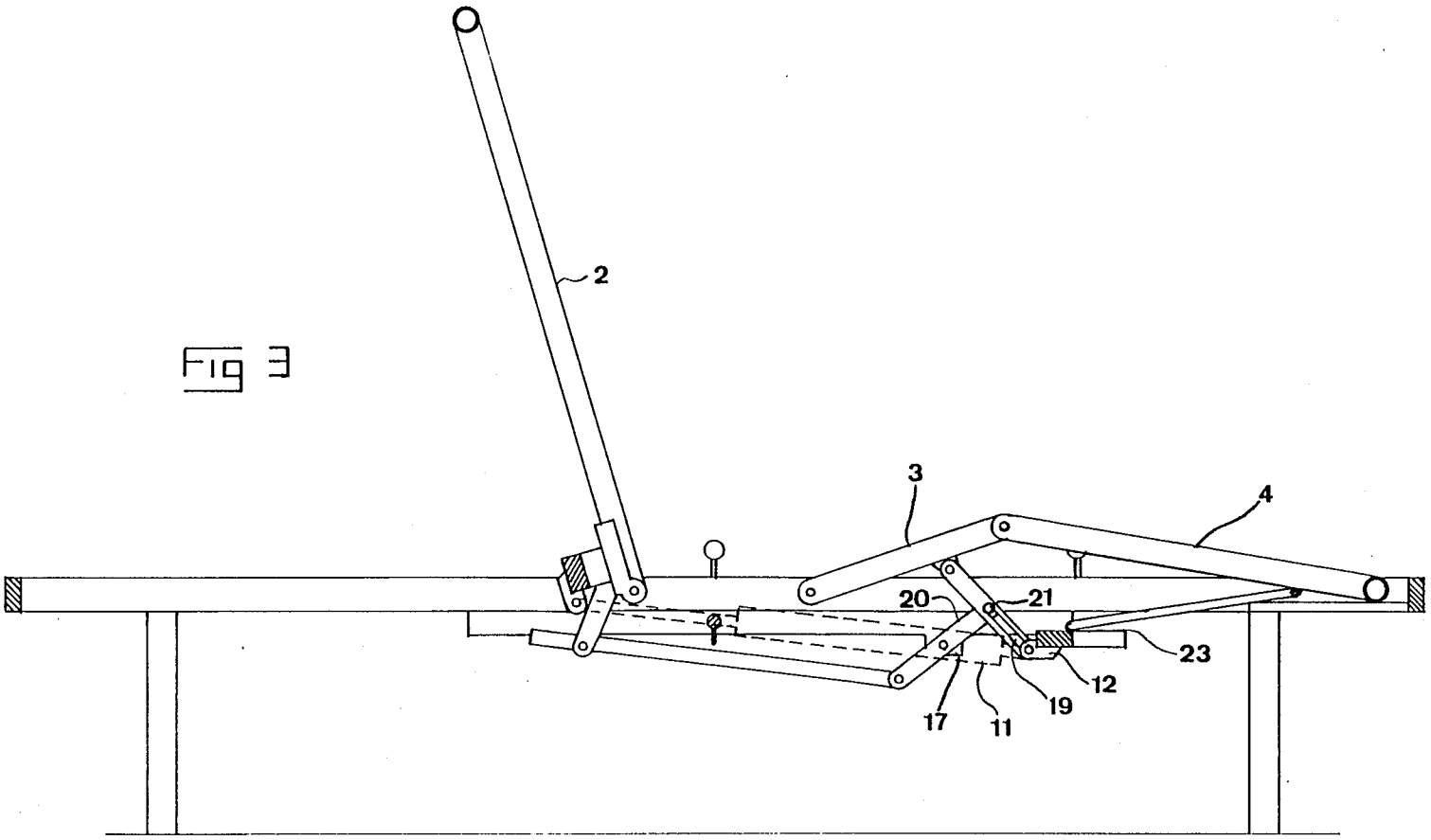
FIG. 3 is a side-elevation of the piece of furniture in FIG. 1, but with the back support even more raised than in FIG. 2.

A first preferred embodiment of the bed according to the invention is shown in different function positions in FIG. 1, 2 and 3, which have in view to make the principle idea of the invention and the constitution of the bed according to the invention clear. All stuffing, mattresses and other things which are not essential for the invention have been omitted in the figures. The bed has a frame work or stand 1, which consists of a stable frame with bed legs rigidly connected thereto. Viewed from the side a back support 2 is through a pivot pivotably connected to the stand about a horizontal axis substantially parallel to the short sides of the bed close to the middle of the stand. A little bit closer to the foot end of the bed, in practice 20 to 40 cm, an elongated thigh supporting part 3 is also through a pivot pivotably connected to the stand 1 about an axis substantially parallel to the pivot axis of the back support. An elongated sank supporting part 4 is about a pivot axis substantially parallel to the aforesaid pivot axis pivotably connected to the end of the side part 3 opposed to the back support 2. The different parts 2–4 are in practice preferably constituted by frames with the same width as the bed, and suitable mattress supporting parts, as for example springs or a lath work, may be arranged within these frames. When a person rests in the bed his back portion and head will rest on the back support 2, the seat partly on the stand 1, of course provided with stuffing, and partly on the thigh part 3, which also supports the thighs, and the shanks will rest on the shank part 4. The shank part may possibly be provided with a footrest. Since the stuffing and the mattresses of the bed have a considerable thickness with respect to the described parts, the body supporting surface will in practice be divided in three parts and the feeling will correspond to a common hinge to the back support 2 and the thigh part 3 half-way between their real hinges on the stand.

In this embodiment the stand has a second shelf 5 at its foot end, upon which shelf the end 6 of the shank part opposed to the back support rests freely slidable. Through the same hinge as the back support a support part 7, upon which the back support rests thanks to the gravitation, is pivotally connected to the stand. The support part consists of a quadrangular beam 8 extending transversally to the longitudinal direction of the bed and a supply 9 rigidly connected to said beam. An attachment 10 is rigidly connected to the beam 8. One of the ends of a power means 11 of length-varying type, e.g. a piston cylinder device, is pivotably connected to the attachment 10. The other end of the power means is pivotably connected to a projection 12 of the stand projecting under the bed bottom. Thus, upon expansion or contraction of the power means 11, the support part 7 will pivot with respect to the stand and the back support 2 freely resting on the support part will follow the support part in this pivoting movement.

The bed according to the invention has a transmission arrangement which makes the movements of the back support, the thigh part and the shank part dependent on each other. This transmission arrangement will now be described. A second projection 13 is arranged on the back support close to the stand, more in detail this projection being rigidly connected to the support part 2 and pointing in a direction downwards under the bed. An elongated first link 14 is pivotably connected to the opposed end of this projection. This link extends towards the foot end of the bed and its end pointing at this foot end is pivotably connected to a first arm 15 of a double-armed lever 16 pivotably connected to the stand. The double-armed lever 16 is pivotably attached to an attachment 17 of the stand projecting downwardly under the bed bottom, this attachment being located under the thigh part 3 and slightly closer to the connection of the latter with the shank part 4 than with the stand 1 in the position according to FIG. 1. A second link 18 is pivotably connected with the under-side of the thigh part 3, slightly closer to its connection with the thigh part than with the stand 1. A longitudinal through-slot 19 starts adjacent to the middle of the second link and extends almost as far as to the end of the link not connected with the thigh part. The double-armed lever 16 has a second arm 20 extending in the opposite direction to the first arm, the end of the second arm being provided with a pin 21, which engages into the slot 19 of the second link and in that way attains a co-operation between the lever 16 and the second link 18.

An elongated support member 22 is pivotably arranged on the under-side of the side part close to its end 6. The stand has in connection with the projection 12 a first shelf 23, on which the opposed end 24 of the support member is slidably displaceably resting.

The function of the preferred embodiment of the invention described above will now be described with reference to FIGS. 1, 2 and 3. In the position according to FIG. 1, the lying position, a power means is maximally contracted and the body supporting surface of the back support 2, the thigh part 3 and the shank part 4, respectively, extends substantially parallel to a horizontal plane. When the power means begins to expand the support part 7 is pivoting relative to the stand 1 and causes the back support resting on the support part to accompany this in the pivoting movement. The second projecting 13 connected to the back support will through the first link 14 influence the first arm 15 of the lever 16, so that the lever pivots clockwise as seen in the figures. By means of the co-operation of the second arm 20, through its pin 21, with the bottom of the slot 19, the second link is pivoted counter-clockwise about this pin and is lifted by the pin. Owing to the pivoting movement of the second link the thigh part 3 will pivot upwardly with respect to the stand 1 and thereby the hinge between the thigh part 3 and the shank part 4 will be raised. This gives rise to a sliding of the end 6 of the shank part on the shelf 5 and the end 24 of the support member on the shelf 23 in the direction of the back support. When the power means has expanded so much that the clockwise pivoting of the lever and the counter-clockwise pivoting of the second link have caused the extensions of these two parts to coincide, the thigh part 3 and the shank part 4 are maximally raised. This condition is shown in FIG. 2 and corresponds preferably to an angle of approximately 45° between the stand and the back support 2, since the shearing forces on a person resting in the bed are the greatest when the back support has this inclination. Continued expansion of the power means gives rise to a continued pivoting upwardly of the back support, while the continued pivoting movements of the lever and the second link cause the thigh part 3 and the shank part 4 to sink towards the initial position shown in FIG. 1 under sliding of the end 6 of the shank part and the end 24 of the support member in the direction of the foot end of the bed. Accordingly, by the bed according to the invention a mutually dependence of the movements of the back support, the thigh part and the shank part is obtained, thanks to which shearing forces generated in the raising of the back support on a person resting in the bed may be counteracted in such a good way as possible.

Figure 4:
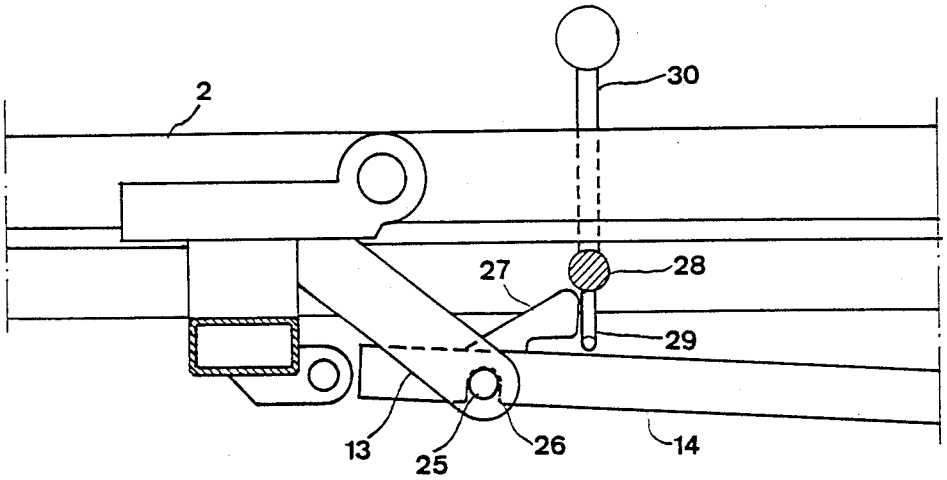
FIG. 4 is a detailed view of a part of the transmission arrangement according to a preferred embodiment.

FIG. 4 illustrates how it may be possible to abolish the function of the transmission arrangement, so that a pivoting upwardly of the back support relative to the stand may take place without affecting the thigh or shank part. The connection between the first link 14 and the second projection 13 connected to the back support is obtained by a pivot 25. The first link has a slot 26 opening to the long side of the link, the bottom of which slot is intended to bear upon the pivot 25. The shoulder 27 is rigidly arranged on the upper side of the first link close to the pivot 25. A rod 28 pivotable about its longitudinal axis is arranged on the stand and extends substantially parallel to the other pivots. A pin 29 and an operating member 30, here an operating lever, are fixed to the rod 28. The bed position shown in FIG. 4 corresponds to the position according to FIG. 1. If the operating lever 30 is moved clockwise as seen in FIG. 4, the rod 28 will pivot about its longitudinal axis and through the pin 29 and the shoulder 27 lift off the first link 14 from the pivot 25 and in that way disconnect the back support 2 and the lever 16. After that the movements of the back support can be operated by the power means 11 without affecting the thigh and shank parts. Once the transmission arrangement has been disconnected it may of course be brought into function again in the lying position of the bed by operating the operating member 30.

Figure 5:
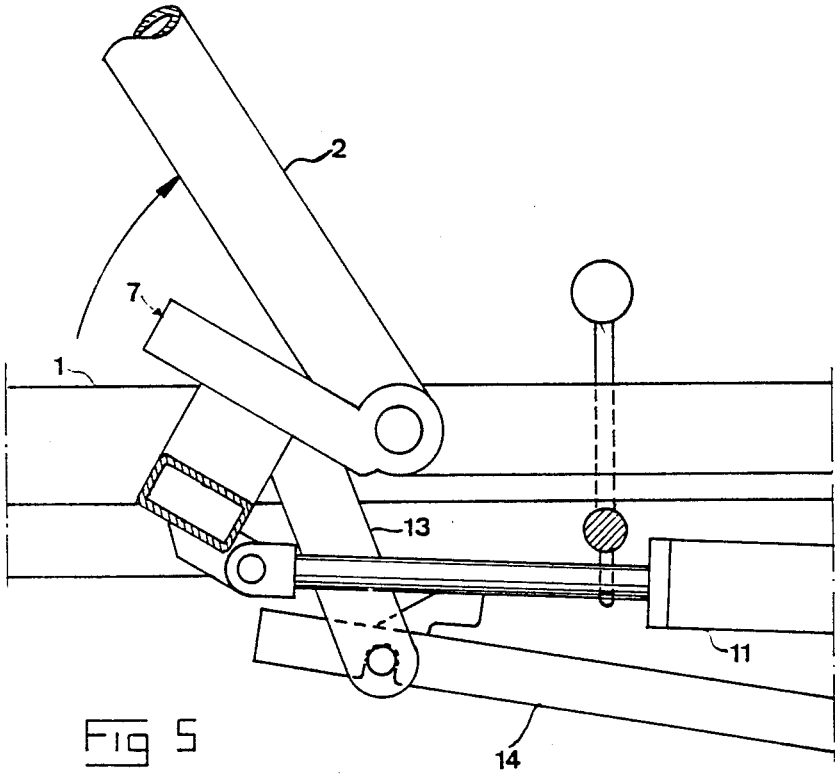
FIG. 5 is a view of the details in FIG. 4, but in another position and with the power means attached, this view illustrating an advantageous characteristic for reducing the jamming risks of the piece of furniture according to the invention.

FIG. 5 illustrates how the forces are reduced to a minimum in a possible jamming between the stand 1 and the bed support 2. Owing to the fact that the back support 2 is resting freely on the support part 7 only by its gravity force and the gravity force of the person resting against the back support, the power means 11 does not exert any forces upon the back support, when it is contracted for lowering of the back support. Thus, if an arm, a finger, a clothing or the like would unintentionally land between the back support and the stand the back support may be pivoted upwardly by hand-power and the squeezed object may be removed, Without the power means counteracting this. The provision of the slot 19 of the second link has the same purpose, whereby the second link rests on the pin 21 only through the gravity force of the the thigh part, the shank part and the person resting in the bed. Due to this it is possible in possible jamming to lift the thigh and shank parts with respect to the stand under displacing the pin 21 in the slot 19, without the slightest influence through the power means 11.

Figure 6:
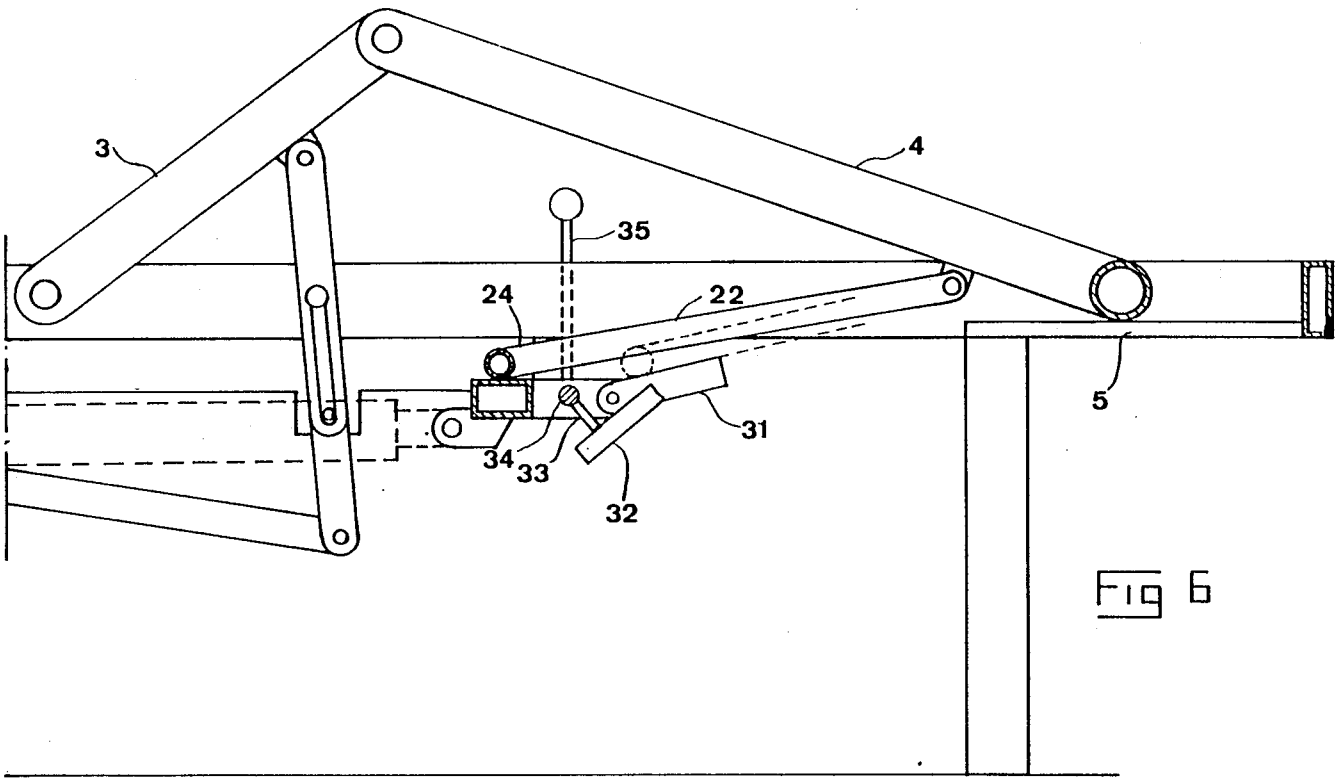
FIG. 6 is an enlarged side-elevation of the half of the piece of furniture in FIG. 1 closest to the legs.
Figure 7:
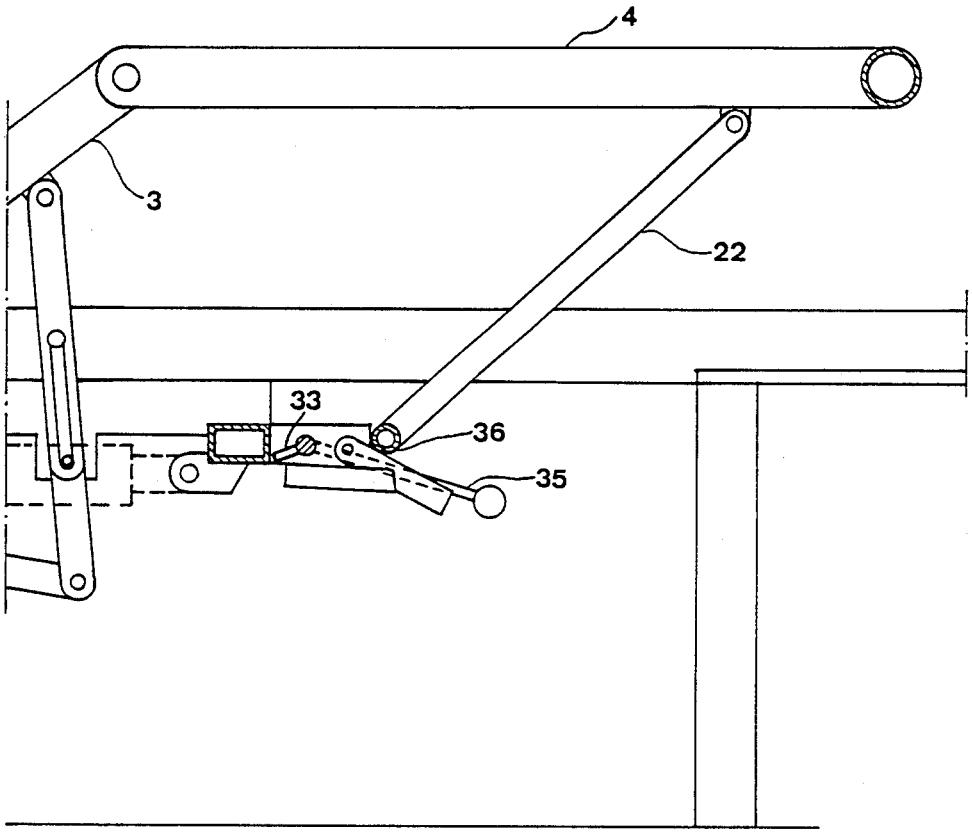
FIG. 7 is a side-elevation illustrating a function possibility of the shank supporting part of the piece of furniture in FIG. 1.

Reference is now made to FIGS. 6 and 7, in which the function of the support member 22 is illustrated. A part of the first shelf 23 consists of a platform 31 pivotably connected to a member secured to the stand, said platform co-operating through a link 32, with a pin 33, which is rigidly connected to a rod 34 about its longitudinal axis pivotably arranged on the stand, the pivot of said rod extending substantially parallel to the other pivot. An operating member 35, here an operating lever, is rigidly connected to the rod 34. When the operating member 35 is in the position shown in FIG. 6 the support member 22 does not affect the movement of the thigh or shank part, but its end 24 slides on the shelf 23 (see FIG. 6). If the operating member 35 in a lying position (FIG. 1) is pivoted clockwise as seen in FIG. 6 to the position according to FIG. 7, the rod 34 will move the pin 33 into such a position that the platform 31 pivots clockwise until the link 32 is hitting the lower side of the shelf 23. A seat 36 between the platform 31 and the rest of the shelf 23 is formed during this pivoting movement. The end 24 of the support member 22 is lodged in this seat. If the power means 11 is expanded now in order to pivot the back support upwardly, and the thigh part 3 is affected by the transmission arrangement, the end 6 of the shank part will not slide on the shelf 5 any longer, but the support member will as a result of the resting of the end 24 in the seat 36 give rise to the lifting of the whole shank part 4, as illustrated in FIG. 7. This function can be desired, when one strives after the neutralizing of the shearing forces earlier discussed, by forming an up-incline, but it is unsuitable to create an unproportionally great bending angle in the knee-joint of the person resting in the bed for the reason of knee injury problems.

Figure 8:
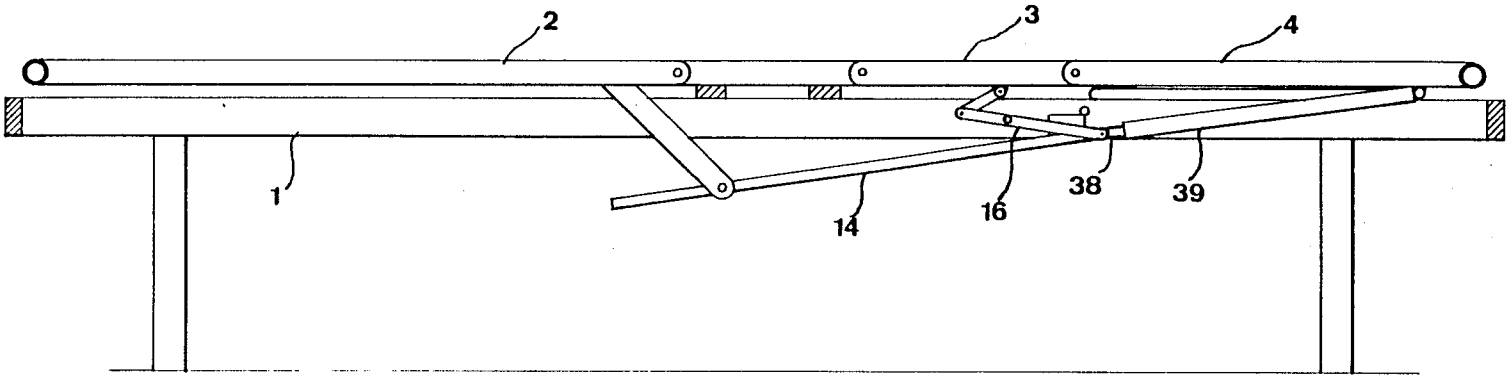
FIG. 8 is a simplified side-elevation of a bed and chair device according to a second preferred embodiment of the invention in horizontal position.
Figure 9:
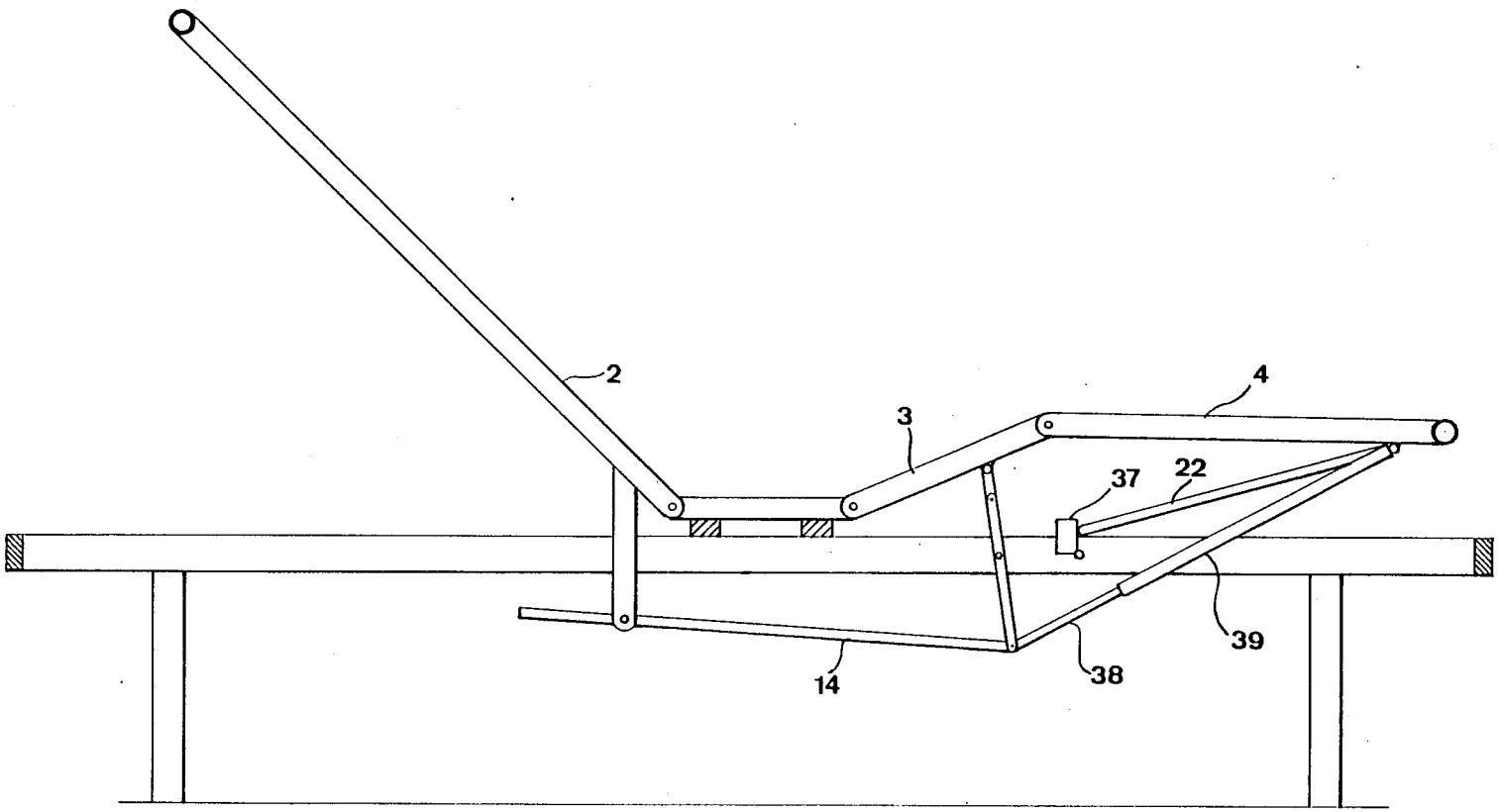
FIG. 9 is a side-elevation of the piece of furniture according to FIG. 8 in a first function position.
Figure 10:
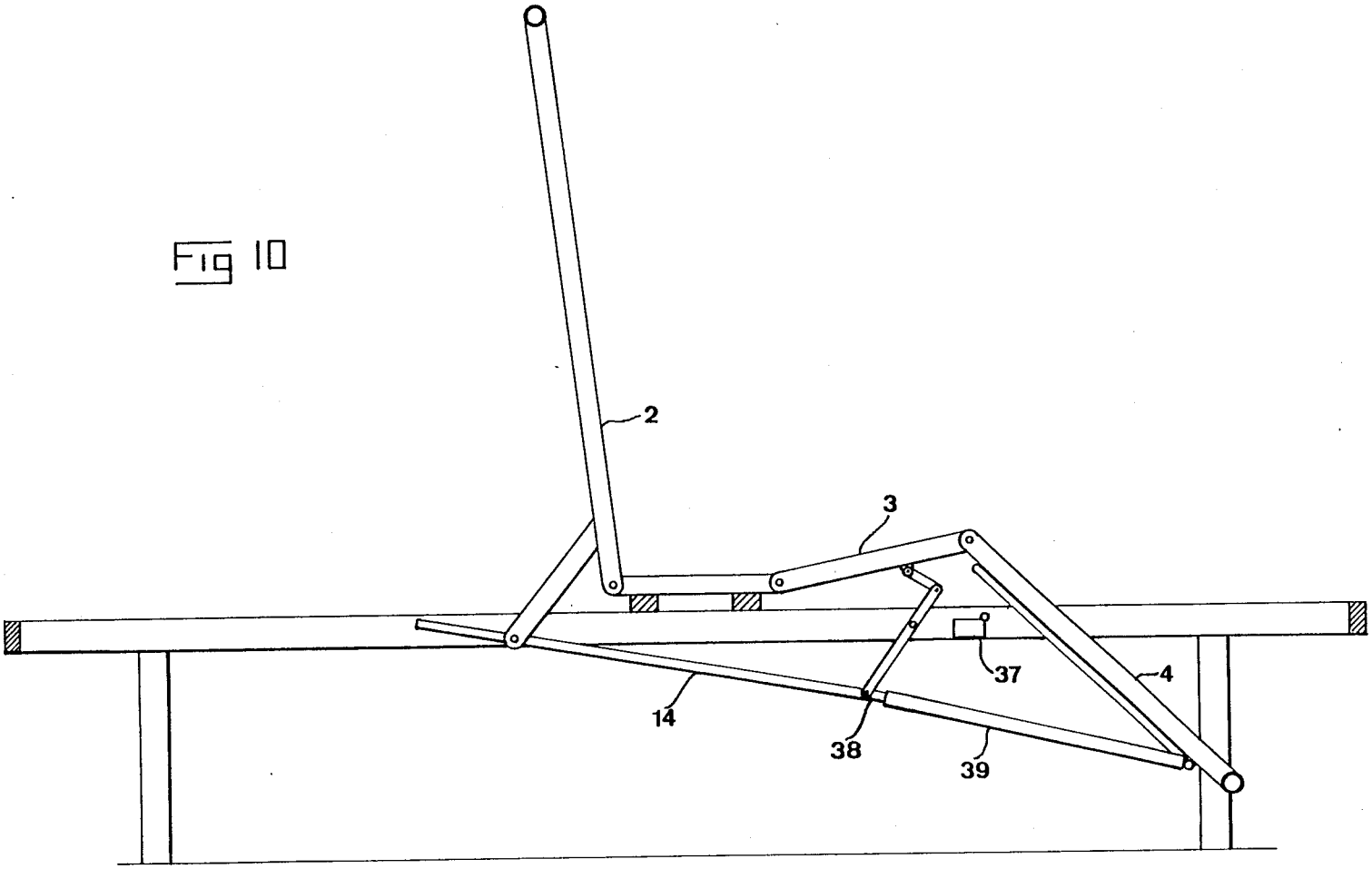
FIG. 10 is a side-elevation of the piece of furniture according to FIG. 8 in a second function position.

The function of another preferred embodiment of the bed according to the invention is shown in FIGS. 8 to 10. Only components essential for the explanation of the different functions of this embodiment in comparison with the embodiment previously discussed are shown in these figures. Although the second link 18 has no slot it is of course possible to provide this link with such a slot in order to avoid unnecessary jamming forces. The bed has a stop 37 which is pivotably connected to the stand and may be pivoted upwardly and downwardly and aside, said stop forming a seat for the end 24 of support member 22 in the upper state according to FIG. 9. When the stop 37 is in the upper state and the support member is located in said seat the function of the bed according to this embodiment is exactly the same as the one of the first embodiment described above. In this second embodiment an elongated bar 38 is pivotably connected to the first arm 15 of the double-armed lever. In the point of connection of the support member and the shank part 4 a second elongated bar 39 is pivotably connected to the shank part. The second bar 39 is hollow and has an inside diameter which is greater than the outside diameter of the bar 38, and the bar 38 is telescopically slidably received in the bar 39. In the raising of the back support from the position according to FIG. 8 into the position according to FIG. 9 said telescope will be extended and does not affect the movement of any of the body supporting parts. However, if the stop 37 in the position according to FIG. 8 is brought aside the function will be different. The case is that this embodiment has no shelf 23 for sliding of the support member 22 and nor has it any shelf 5 for sliding of the end 6 of the shank part. When, starting from the position according to FIG. 8, the back support is pivoted upwardly the pivoting movement of the lever 16 will cause the shank part 4 to pivot downwardly, so that its end 6 comes closer and closer to the floor the more the back support is pivoted upwardly. This is obtained owing to that the gravity force of the shank part and the shanks resting thereon tends to hold the telescope formed by the two rods 38 and 39 together in the contracted state. Although the thigh part 3 begins to go back towards its initial position after passing the position corresponding to a maximal up-incline, the shank part 4 will continue its downward-movement during the continued upward-pivoting of the back support. Through this function it is possible to obtain a sitting position comfortable for many persons, said position corresponding to the position according to FIG. 10.

The invention is not delimited to the preferred embodiments described above, but a plurality of modification possibilities thereof would be apparent to a man skilled in the art to which the invention pertains, without deviating from the scope of the invention.

For example it would be possible to attach the power means between the stand and the thigh part, so that the movement of the back support is affected by the transmission arrangement. It would also be possible to connect the second link to the shank part instead of the thigh part.

The power means could be of another type than the length-varying one, it is only essential that it brings the different parts to carry out appropriate movement. The connections to the power means, as electricity cables or fluid conduits, have of course been omitted in the figures for the sake of clearness.

The back support and the thigh part could be pivotably connected to the stand about one and the same hinge.

It would also be possible to prolong the thigh part, so that it will also serve as a shank supporting part and that the bed in practice will be constituted by two parts.

I claim:

1. A bed and/or chair device comprising a stand (1) and a support surface arrangement (2, 3, 4) which is divided in at least two mutually movable parts, viz a back support (2) and a thigh supporting and possibly also seat supporting part (3), the back support (2) and the thigh supporting part (3) being pivotably connected to the stand (1), power means (11) being arranged to cause a pivoting movement of the back support between different inclination positions with respect to the stand, characterized in that a transmission arrangement is arranged to make the movements of the back support and the thigh supporting part dependent on each other, s that in pivoting the back support (2) upwardly from a substantially horizontal position, the thigh supporting part (3) is initially pivoted upwardly with respect to the stand (1), until a maximally raised position is reached, after which a continued pivoting upwardly of the back support causes the thigh supporting part to pivot downwardly toward its initial position, a shank supporting part (4) being pivotably connected to the thigh supporting part (4), the pivot between the latter parts being positioned so as to correspond with the knee-joint of the person resting in the device, characterized in that an elongated support member (22) is at its one end pivotably connected to the shank supporting part (4), that the other end (24) of the support member is designed to be able to rest undisplaceably in a stopping member arranged on the stand, so that a pivoting upwardly of the thigh supporting part (3) with respect to the stand (1) causes the entire shank supporting part (4) to be lifted to a position in which the latter part preferably is extending close to a horizontal plane and in any case does not point with its end opposed to the back support (2) in an upward direction making a greater angle with the stand (1) than the thigh supporting part (3) does.

2. The bed and/or chair device according to claim 1, characterized in that the transmission arrangement comprises a double-armed lever (16) pivotably connected to the stand (1) under the thigh supporting part (3), the one arm (15) of said lever being through at least a first link (14) connected to the back support (2) and the other lever arm (20) being arranged to cooperate with a second link (18) pivotably connected to the thigh supporting part, that the mutually arrangement and dimensioning of the lever (16) and said links (14, 18) is so that, when the back support (2) by means of the power means (11) is pivoted upwardly from a substantially horizontal position, the lever (16) is affected to pivot by the action of the first link (14) on the first arm (15), through which the second arm (20) causes the second link (18) , in lifting this link upwardly, to pivot towards a position in which the direction of the lever arms and of the second link correspond, during which the second link (18) lifts the thigh supporting part (3), and that continued pivoting of the second link causes its pivot associated with the thigh supporting part (3) to sink and the thigh supporting part to sink.

3. The bed and/or chair device according to claim 2, characterized in that a member (13) connected to the lower portion of the back support is arranged, and that the first link (14) consists of an elongated part having one of its ends pivotably connected to this member and the other end pivotably connected to the first arm (15) of the lever.

4. The bed and/or chair device according to claim 1, characterized in that an operating member (35) is arranged to bring the free end (24) of the support member (22) into and out of engagement with said seat or stop (37), respectively, that a first shelf (23) is so arranged on the stand (1), that, when the support member is out of engagement with the stopping member, its free end (24) is able to slide upon said shelf (23) during the movement of the shank supporting part (4), through which the support member accordingly does not influence the movement of the shank supporting part.

5. The bed and/or chair device according to claim 4, characterized in that one of the ends of a first bar (38) is pivotably connected to the first arm (15) of the lever, that one of the ends of a second bar (39) is pivotably connected to the shank supporting part (4) close to the end of the latter opposed to the back support (2), the first and the second bars (38, 39) being displaceably co-ordinated in a telescopically way, so that, when the free end (24) of the support member is located in said stopping member, the telescope member, owing to displacement of the first bar (38) with respect to the second (39), does not have any effect on the movement of the shank supporting part when the back support (2) is pivoted with respect to the stand (1), and that, when the free end (24) of the support member is not located in said seat (36, 37), an upward-pivoting of the back support (2) causes the end of the shank supporting part opposed to the back support to sink past and under the stand, during which the telescope member acts against the force of gravity of the shank supporting part by being contracted and in the contracted state supporting the shank supporting part (4).

6. The bed and/or chair device according to claim 1, characterized in that the stand (1) has a second shelf (5) upon which the end (6) of the shank supporting part (4) opposed to the back support (2) is arranged to slide during the pivoting movement of the thigh supporting part (3) when the support member (22) is not located in said stopping member.

7. The bed and/or chair device according to claim 3, characterized in that the connection between said first link (14) and the member (13) connected to the back support (2) can be released by means of a second operating member (30), preferably the connection being obtained through a pivot (25) on said part (13) or alternatively on the first link and a second seat or slot (26) for the pivot in the first link or alternatively in said member (13), the second operating member (30) being arranged to cause lifting of the first link (14) and by that release of the engagement between the second seat or slot (26) and the pin (25) and abolishing the dependence between the movement of the back support and the movement of the thigh supporting part.

8. The bed and/or chair device according to claim 3, characterized in that the second link (18) has a slot (19) extending in the longitudinal direction thereof, that the outer end of the second arm (20) of the lever has a pin (21) displaceably arranged in said slot (19) so that the lever (16) co-operates with the second link by the action of the pin at the end of the slot in the direction towards the thigh supporting part (3), and that, when the lever (16) moves in such a way that the thigh supporting part (3) sinks, the latter only sinks owing to the gravity force, which causes the bottom of the slot (19) to rest on the pin (21), through which the pin (21) is allowed to slide in the slot (19) when there is an obstacle to sinking of the thigh supporting part (3).

9. A bed and/or chair device comprising a stand (1) and a support surface arrangement (2, 3, 4), which is divided in at least two mutually movable parts, viz a back support (2) and a thigh supporting and possibly also seat support part (3), the back support (2) and the thigh supporting part (3) being pivotably connected to the stand (1), power means (11) being arranged to cause a pivoting movement of the back support between different inclination positions with respect to the stand, charcterized in that a transmission arrangement is arranged to make the movement of the back support and the thigh supporting part dependent on each other, so that in pivoting the back support (2) upwardly from a substantially horizontal position, the thigh supporting part (3) is initially pivoted upwardly with respect to the stand (1), until a maximally raised position is reached, after which a continued pivoting upwardly of the back support causes the thigh supporting part to pivot downwardly toward its initial position, wherein said power means (11) is of the length-varying type and connected on one hand to the stand (1) and on the other to a support part (7) pivotably connected to the pivot between the back support (2) and the stand, and that the back support is connected to the support part only by resting on the support part through gravitation, so that the power means (11) indirectly affects the back support (2) by pivoting the support part (7) with respect to the stand (1) so as to restrict possible jamming forces between the back support and other members to comprise only the gravity force of the back support and possibly a person leaning thereon.

10. A bed and/or chair device comprising a stand (1) and a support surface arrangement (2, 3, 4), which is divided in at least two mutually movable parts, viz a back support (2) and a thigh supporting and possibly also seat supporting part (3), the back supporting (2) and the thigh supporting part (3) being pivotably connected to the stand (1), power means (11) being arranged to cause a pivoting movement of the back support between different inclination positions with respect to the stand, characterized in that a transmission arrangement is arranged to make the movements of the back support and the thigh supporting part dependent on each other, so that in pivoting the back support (2) upwardly from a substantially horizontal position, the thigh supporting part (3) is initially pivoted upwardly with respect to the stand (1), until a maximally raised position is reached, after which a continued pivoted upwardly of the back support causes the thigh supporting part to pivot downwardly towards its initial position, the transmission arrangement comprises a double-armed lever (16) pivotably connected to the stand (1) under the thigh supporting part (3), the one arm (15) of said lever being through at least a first link (14) connected to the back support (2) and the other lever arm (20) being arranged to cooperate with a second link (18) pivotably connected to the thigh supporting part, that the mutually arrangement and dimensioning of the lever (16) and said links (14, 18) is so that, when the back support (2) by means of the power means (11) is pivoted upwardly from a substantially horizontal position, the lever (16) is affected to pivot by the action of the first link (14) on the first arm (15), through which the second arm (20) causes the second link (18), in lifting this link upwardly, to pivot towards a position in which the direction of the lever arms and of the second link correspond, during which the second link (18) lifts the thigh supporting part (3), and that continued pivoting of the second link causes its pivot associated with the thigh supporting part (3) to sink and the thigh supporting part to sink.

11. The bed and/or chair device according to claim 10 characterized in that a member (13) connected to the lower portion of the back support is arranged, and that the first link (14) consists of an elongated part having one of its ends pivotably connected to this member and the other end pivotably connected to the first arm (15) of the lever.

12. The bed and/or chair device according to claim 11 characterized in that the connection between said first link (14) and the member (13) connected to the back support (2) can be released by means of a second operating member (30), preferably the connection being obtained through a pivot (25) on said part (13) or alternatively on the first link and a second seat or slot (26) for the pivot in the first link or alternatively in said member (13), the second operating member (30) being arranged to cause lifting of the first link (14) and by the release of the engagement between the second seat or slot (26) and the pin (25) and abolishing the dependence between the movement of the back support and the movement of the thigh supporting part.

13. The bed and/or chair device according to claim 11 characterized in that the second link (18) has a slot (19) extending in the longitudinal direction thereof, that the outer end of the second arm (20) of the lever has a pin (21) displaceably arranged in said slot (19) so that the lever (16) cooperates with the second link by the action of the pin at the end of the slot in the direction towards the thigh supporting part (3), and that, when the lever (16) moves in such a way that the thigh supporting part (3) sinks, the latter only sinks owing to the gravity force, which causes the bottom of the slot (19) to rest on the pin (21), through which the pin (21) is allowed to slide in the slot (19) when there is an obstacle to sinking of the thigh supporting part (3).

* * * * *